US006116794A

United States Patent [19]

Nelson et al.

[11] Patent Number: 6,116,794

[45] Date of Patent: Sep. 12, 2000

[54] APPARATUS FOR COOLING A THERMALLY PROCESSED MATERIAL

[75] Inventors: Graham F. Nelson, Roseville; Curt A. Wiens, St. Paul, both of Minn.

[73] Assignee: Eastman Kodak Company, Rochester, N.Y.

[21] Appl. No.: 09/144,382

[22] Filed: Aug. 31, 1998

[51] Int. Cl.[7] ..... G03D 13/00; G03D 7/00

[52] U.S. Cl. ..... 396/575; 396/579; 355/30; 355/405

[58] Field of Search ..... 396/575, 579; 355/30, 27–29, 100, 106; 250/318, 319, 319.1; 34/266, 62, 447, 575, 618, 620; 428/29, 90

[56] References Cited

U.S. PATENT DOCUMENTS

| | | | |
|---|---|---|---|
| 1,378,721 | 5/1921 | Rohdiek | 219/388 |
| 3,570,383 | 3/1971 | Berg | 396/579 |
| 3,817,618 | 6/1974 | Riley et al. | 355/100 |
| 4,105,323 | 8/1978 | Moraw et al. | 399/132 |
| 4,322,158 | 3/1982 | Frias et al. | 355/27 |
| 4,485,294 | 11/1984 | Rosenberg | 219/216 |
| 5,023,654 | 6/1991 | Matsumoto et al. | 355/27 |
| 5,352,863 | 10/1994 | Svendsen | 219/388 |
| 5,414,488 | 5/1995 | Fujita et al. | 355/30 |
| 5,502,532 | 3/1996 | Biesinger et al. | 396/575 |
| 5,563,681 | 10/1996 | Kirkwold et al. | 355/30 |
| 5,699,101 | 12/1997 | Allen | 347/212 |
| 5,849,388 | 12/1998 | Preszler et al. | 428/90 |

FOREIGN PATENT DOCUMENTS

| | | | |
|---|---|---|---|
| 0 476 694 A2 | 3/1992 | European Pat. Off. | G03B 27/30 |
| 0 679 946 A1 | 11/1995 | European Pat. Off. | G03D 13/00 |
| 0 679 947 A1 | 11/1995 | European Pat. Off. | G03D 13/00 |

*Primary Examiner*—D. Rutledge
*Attorney, Agent, or Firm*—William F. Noval

[57] ABSTRACT

Disclosed is an apparatus for cooling a thermally processed, imaging material which has been heated to a first temperature by a thermal processor. The cooling apparatus includes a cooling article, on which the imaging material rides after the imaging material exits the thermal processor, and an imaging material transport mechanism. The cooling article is at a lower temperature than the first temperature to cool the imaging material. The transport mechanism conveys the imaging material over the cooling article. The transport mechanism operates at a rate of speed that is faster than an operational rate of speed of an imaging material conveyance device of the thermal processor. This speed differential allows the transport mechanism to apply tension to the imaging material as the imaging material passes over the cooling article to minimize imaging material defects during cooling.

24 Claims, 6 Drawing Sheets

APPARATUS FOR COOLING A THERMALLY PROCESSED MATERIAL

TECHNICAL FIELD

This invention relates to photothermographic processors that use thermally processable film. In particular, the present invention is an apparatus for cooling a thermally developed film so as to minimize physical and image defects in the developed film that would adversely affect the quality of the resulting film image.

CROSS REFERENCE TO RELATED APPLICATIONS

This patent is related to U.S. patent application Serial No. XX/XXX,XXX (Attorney Docket No. I200.123.101) entitled "Thermal Processor Employing a Temperature Compensation System" filed on even date herewith and assigned to the same assignee.

BACKGROUND OF THE INVENTION

Various medical, industrial and graphic imaging applications require the production of very high quality images. One way to produce high quality images is through the use of a photothermographic processor. One type of photothermographic processor uses a thermally processable, light sensitive photothermographic film that typically includes a thin polymer or paper base coated with an emulsion of dry silver or other heat sensitive material. This photothermographic film may take the form of short sheets, longer lengths or continuous rolls of photothermographic material. These sheets, lengths and rolls are often referred to as photothermographic elements.

A photothermographic processor generally includes a photothermographic element exposure system, a thermal processing mechanism and a cooling apparatus. The exposure system typically employs a laser scanner device that produces laser light that exposes the photothermographic element to form a latent image thereon. The thermal processing mechanism is used to thermally develop this latent image. To develop the latent image, the thermal processing mechanism heats the exposed photothermographic element to at least a threshold development temperature for a specific period of time to develop the image within the photothermographic element. Subsequently, the photothermographic element must be cooled by the cooling apparatus of the photothermographic processor to allow a user to hold the element while examining the developed image.

During cooling, the photothermographic element is susceptible to physical and image defects. These defects are primarily due to uneven cooling of the developed photothermographic element and dimensional changes that occur in the element during cooling. Uneven cooling across the developed photothermographic element and uncontrolled dimensional changes which occur during cooling cause thermal stresses and contraction within the element. These thermal stresses and contraction can cause physical and image wrinkles, streaks and/or spots (i.e., defects), in the developed photothermographic element, which can significantly affect the quality of the developed image.

In addition to the physical and image defects that can occur during cooling, a photothermographic element is also susceptible to physical and image defects caused in other ways. For example, physical and image defects can occur in the photothermographic element due to buckling of the element caused by a speed mismatch, where an element transport device of the cooling apparatus is moving at a speed slower than the speed of a transport device of the thermal processing mechanism. Buckling of the photothermographic element within the thermal processing mechanism can result in uneven contact between heated development rollers of the thermal processing mechanism and the element during the development process. This uneven contact can cause under-development of portions of the latent image, thereby resulting in image artifacts that adversely affect the quality of the developed image. Buckling of the photothermographic element within the cooling apparatus can result in uneven cooling of the element, resulting in image affecting physical defects within the photothermographic element and possible element jams.

There is a need for an improved apparatus for cooling thermally processed, photothermographic elements. In particular, there is a need for a photothermographic element cooling apparatus which sufficiently cools a developed photothermographic element to allow a user to hold the element for examining the developed image, and minimizes physical and image defects in the developed image that would adversely affect the image quality of the developed photothermographic element. In addition, the photothermographic element cooling apparatus should provide these features while offering acceptable cooling productivity, cost effectiveness, and ease of assembly and repair.

SUMMARY OF THE INVENTION

The present invention is an apparatus for cooling a thermally processed, imaging material which has been heated to a first temperature by a thermal processor of the type having an imaging material conveyance device operating at an operational rate of speed. The cooling apparatus includes a cooling article, on which the imaging material rides after the imaging material exits the thermal processor, and an imaging material transport mechanism. The cooling article has a second temperature that is lower than the first temperature so as to cool the imaging material. The transport mechanism is adjacent to the cooling article and engages the imaging material to convey the imaging material over the cooling article. The transport mechanism operates at a rate of speed that is faster than an operational rate of speed of an imaging material conveyance device of the thermal processor.

This cooling apparatus minimizes physical and image defects during cooling. Since the imaging material transport mechanism of the cooling apparatus has a higher operational rate of speed than the imaging material conveyance device of the thermal processor, the transport mechanism applies tension to the imaging material as the imaging material passes over the cooling article. This tension insures that the imaging material evenly contacts the cooling article and thereby insures even cooling of the developed imaging material. In addition, the tension also helps to control the dimensional changes that occur in the developed imaging material during cooling. Even cooling of the imaging material, and control of imaging material dimensional changes reduces thermal stresses and contraction within the imaging material. By reducing imaging material thermal stresses and contraction, physical and image wrinkles, streaks, and/or spots in the developed imaging material are minimized, which significantly improves the quality of the developed image.

By operating at a higher rate of speed than the conveyance device of the thermal processor, the transport mechanism of the cooling apparatus also prevents buckling of the imaging material caused by a speed mismatch where the transport mechanism of the cooling apparatus is operating at a speed slower than the speed of the conveyance device of the thermal processor. By preventing buckling of the developed imaging material, uneven contact between heated development rollers of the thermal processor and the imaging material, during the development process, is minimized. Hence, there is a corresponding reduction in underdeveloped portions of the imaging material which translates into fewer image and physical artifacts that would adversely affect the quality of the developed image. The cooling apparatus of the present invention minimizes these physical and image artifacts while offering acceptable cooling productivity, cost effectiveness and ease of assembly and repair.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
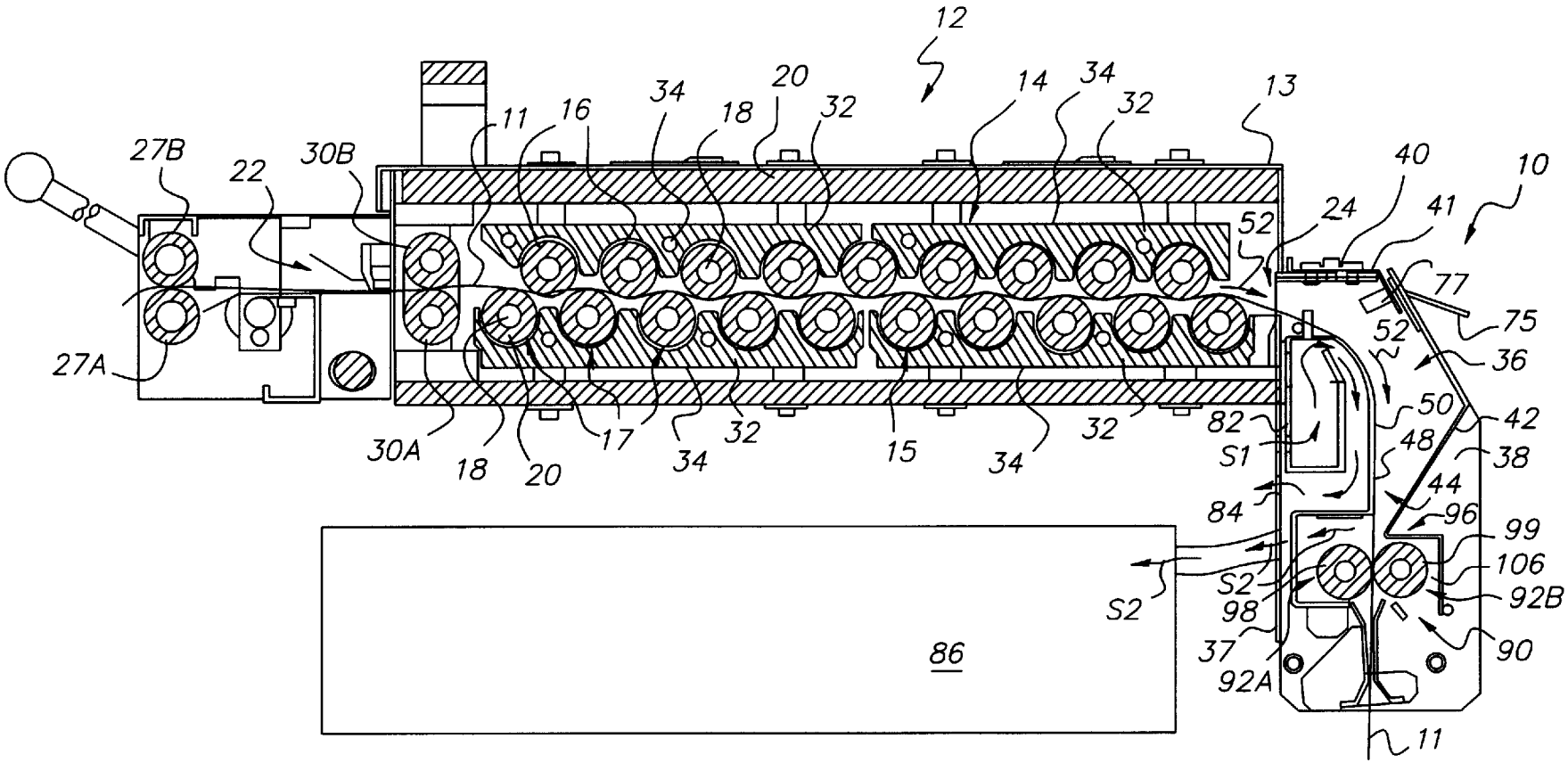
FIG. 1 is a side sectional view of a photothermographic processor incorporating an apparatus for cooling thermally processed material in accordance with the present invention.
Figure 2:
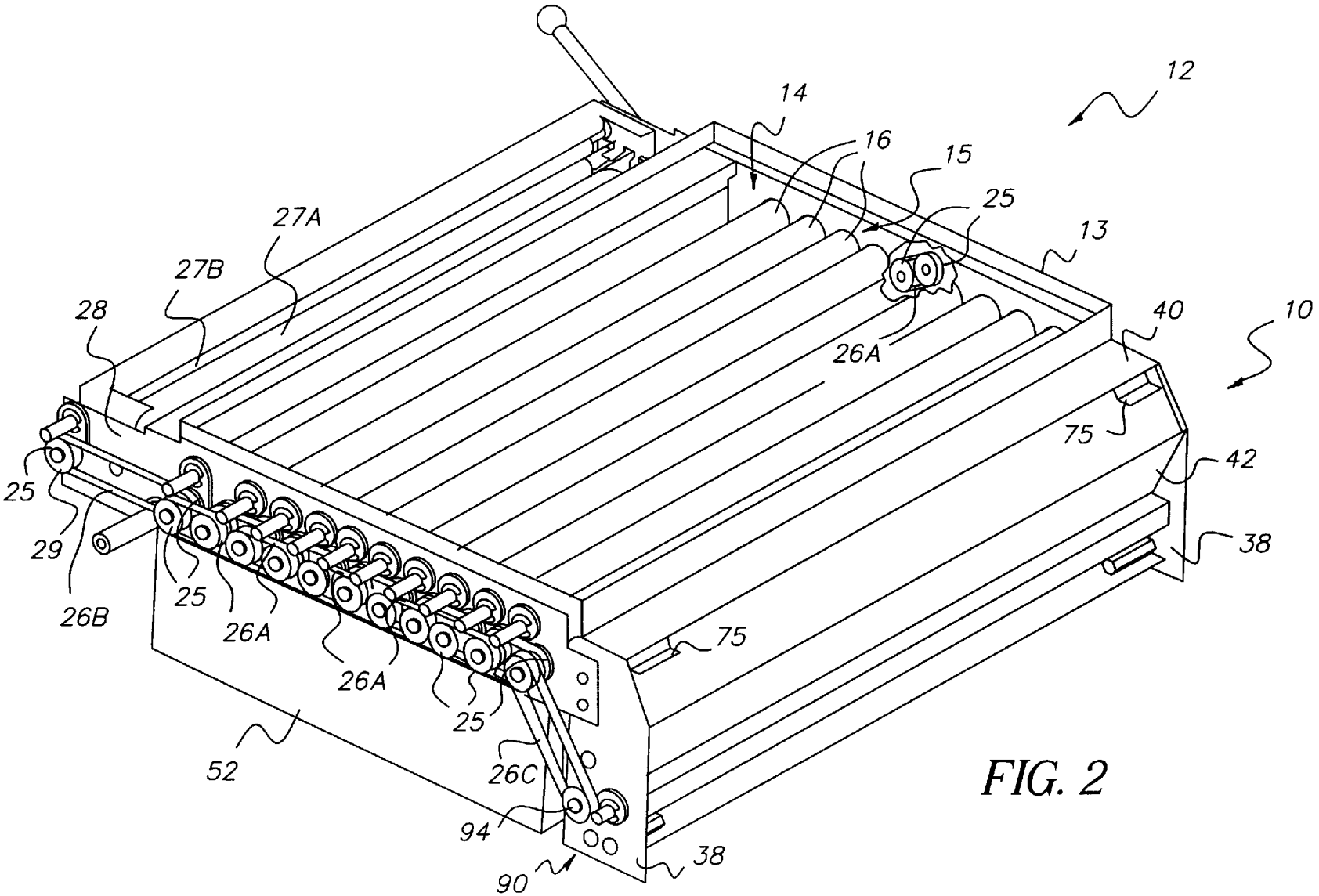
FIG. 2 is a perspective view of the photothermographic processor with the top removed therefrom and the cooling apparatus shown in FIG. 1.

An apparatus 10 for cooling a thermally processed, imaging element or material 11 in accordance with the present invention is illustrated generally in FIGS. 1 and 2. The cooling apparatus 10 forms part of a photothermographic processor 12 which includes a thermal processor 13. As seen best in FIG. 1, the thermal processor 13 has a heated enclosure oven 14 and an imaging material conveyance device 15 defined by a number of upper rollers 16 and lower rollers 17 arranged in a corrugated pattern. Upper and lower rollers 16 and 17 can include support rods 18 with cylindrical sleeves of a support material 20 which surrounds the external surface of the rods 18. The rods 18 are rotatably mounted to the opposite sides of the oven 12 to orient the rollers 16 and 17 in a spaced relationship about a transport path between an oven entrance 22 and an oven exit 24. The rollers 16 and 17 are positioned to contact the thermally processable material 11 (hereinafter TPM 11). Examples of thermally processable imaging materials include thermographic or photothermographic film (a film having a photothermographic coating or emulsion on at least one side). The term "imaging material" includes any material in which an image can be captured, including medical imaging films, graphic art films, imaging materials used for data storage and the like.

One or more of the rollers 16 and 17 of the imaging material conveyance device 15 can be driven in order to drive the TPM 11 through the oven 14 of the thermal processor 13. Preferably, as seen best in FIG. 2, all of the upper and lower rollers 16 and 17 are drive rolls. In one embodiment, at one side of the thermal processor 13, each of the lower rollers 17 includes a pair of pulleys 25 that allow adjacent lower rollers 17 to be coupled and driven through a series of drive belts 26A. As seen in the broken out portion of FIG. 2, on the opposite side of the thermal processor 13 each of the upper and lower rollers 16 and 17 includes a single pulley 25 that allow adjacent pairs of upper and lower rollers 16 and 17 to be coupled and driven through drive belts 26A. Alternatively, the upper and lower rollers 16 and 17 could all be driven through a series of coupled gears. In this embodiment, each of the upper and lower rollers 16 and 17 would include a single drive gear, with each gear of an upper roller 16 meshing with both gears of the two adjacent lower rollers 17 (i.e., in a zig-zag chain like arrangement).

As seen best in FIG. 1, the photothermographic processor 12 includes a pair of primary nip rollers 27A and 27B. The lower nip roller 27A is a drive roll while the upper nip roller 27B is a driven or idler roll. The lower nip roller 27A includes a single pulley 25 (FIG. 2) and is operably coupled to a drive motor 28 of the photothermographic processor 12 for driving lower nip roller 27A in a clockwise direction as represented by arrow 29. Adjacent to the oven entrance 22, is a pair of oven nip rollers 30A and 30B (FIG. 1). The lower nip roller 30A is a drive roll while the upper nip roller 30B is a driven or idler roll. Like one end of the lower rollers 17, the lower nip roller 30A includes a pair of pulleys 25 (FIG. 2) and is operably connected to the lower nip roller 27A through a drive belt 26B. The lower nip roller 30A in turn operably drives the lower rollers 17 through a further like drive belt 26A. Alternatively, the lower nip roller 30A could be operably coupled to the lower nip roller 27A and the lower drive rollers 17 through a series of gears. As a further alternative, the lower nip roller 30A and the upper and lower drive rollers 16 and 17 of the conveyance device 15 could be driven directly from the drive motor 28.

All of the pulleys 25 are identical so that all the upper and lower rollers 16 and 17, lower nip roller 27A and lower nip roller 30A operate (i.e., rotate) at the same operational rate of speed to convey the TPM 11 through the thermal processor 13 at a constant imaging material conveying rate of speed. The operational rate of speed of the upper and lower drive rollers 16 and 17 of the conveyance device 15 and the lower nip rollers 27A and 30A is substantially equal to the imaging material conveying rate of speed of the conveyance device 15 and nip rollers 27A and 30A. In one preferred embodiment, the operational and conveying rates of speed of the upper and lower drive rollers 16 and 17 of the conveyance device 15 and the lower nip rollers 27A and 30A is 0.54 inches per second as measured by the surface speed of the TPM 11 through the thermal processor 13.

As seen best in FIG. 1, the rollers 16 and 17 of the imaging material conveyance device 13 drive the TPM 11 through the oven 14 and adjacent to the heated members 32 which are heated via blanket heaters 34 of the thermal processor 13. The heated members 32 heat the TPM 11 to a first temperature to develop the latent image on the TPM 11. Once the latent image is developed, the TPM 11 passes out of the oven exit 24 and into a cooling chamber 36 of the cooling apparatus 10. The cooling chamber 36 lowers the temperature of the TPM 11 to stop the thermal development while minimizing the creation of wrinkles in the TPM 11, the curling of the TPM 11, and the formation of other cooling defects. In addition, cooling of the TPM 11 allows a user to hold the TPM 11 to examine the developed image.

Figure 3:
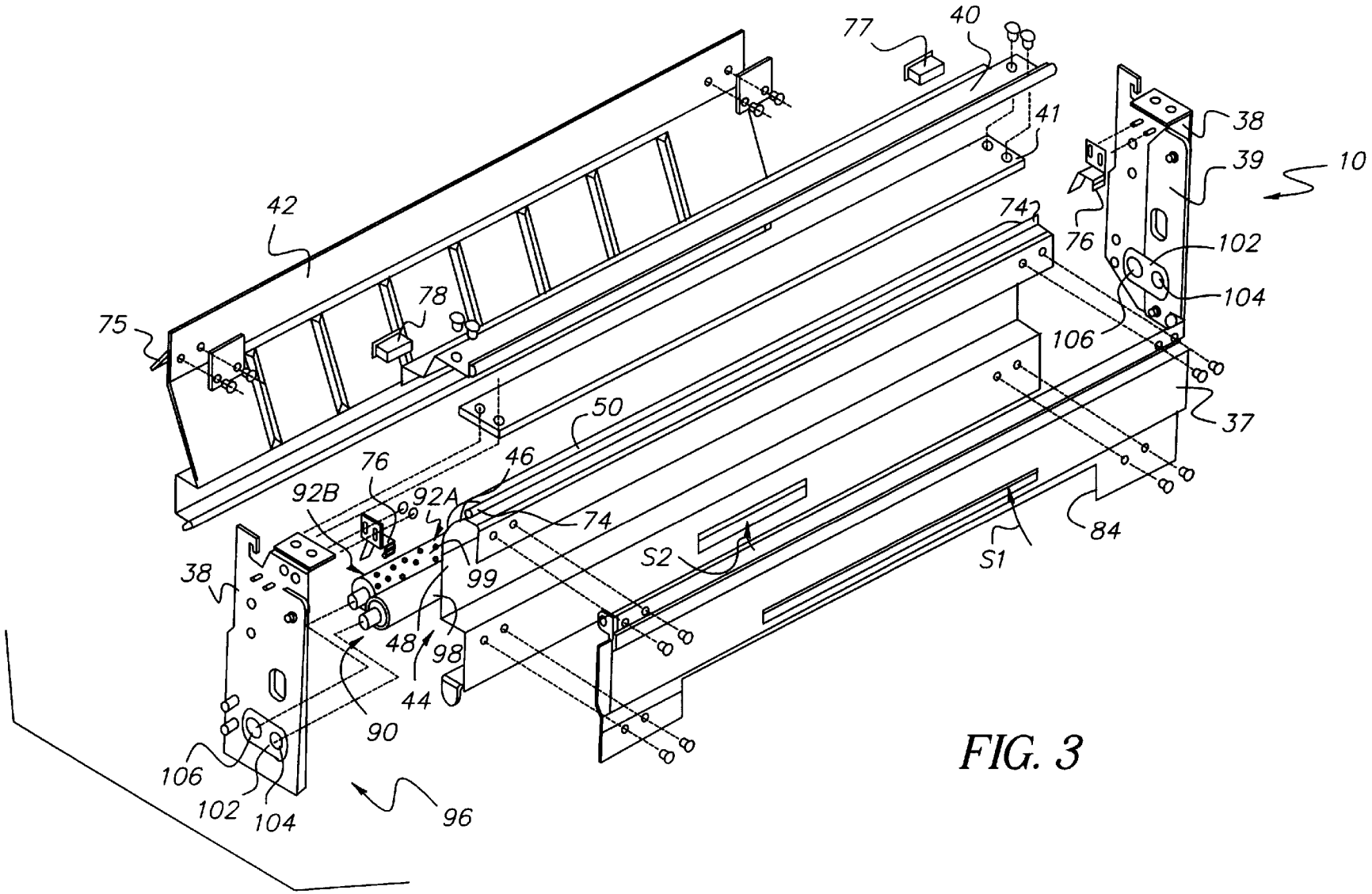
FIG. 3 is an exploded perspective view of the cooling apparatus shown in FIGS. 1 and 2.
Figure 6:
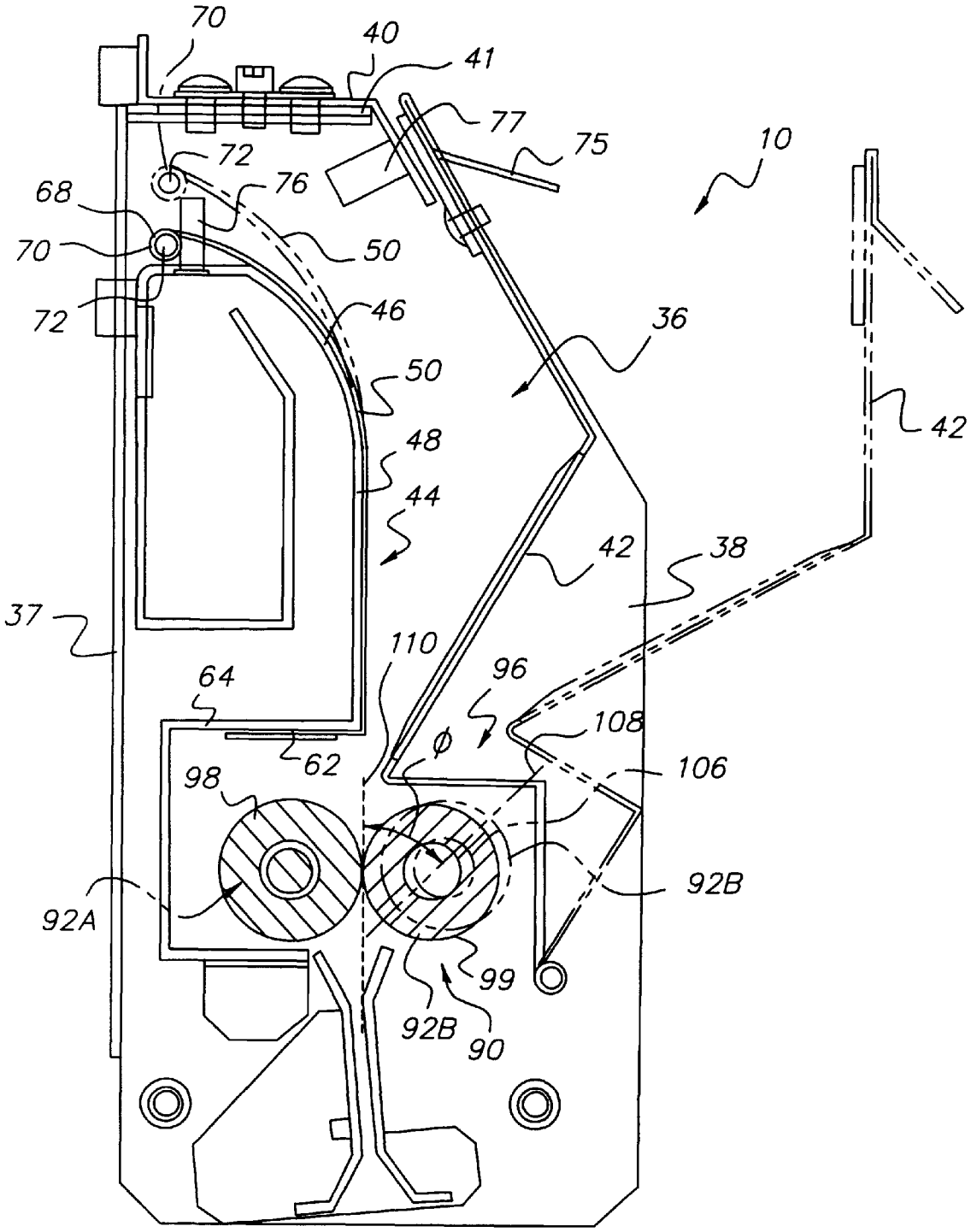
FIG. 6 is an enlarged side sectional view of the nip roller mechanism shown in FIGS. 4 and 5.

As seen in FIGS. 1, 3 and 6, the cooling apparatus 10 includes a rear wall 37, opposite end walls 38 having reinforcing members 39, a top wall 40 having a reinforcing member 41 and a hinged cover member 42 that together define the cooling chamber 36. The rear wall 37 of the cooling apparatus 10 is positioned adjacent to the oven exit 24 of the thermal processor 13. Positioned within the cooling chamber 36 of the cooling apparatus 10 is a cooling article 44. The cooling article 44 has a second temperature that is lower than the first temperature of the TPM 11 as it exits the thermal processor 13. This acts to cool the heated TPM 11. The cooling article 44 includes a first, generally curved cooling section 46 and a second generally straight cooling section 48. Contact between the heated TPM 11 and the curved first cooling section 46 cools the TPM 11 while the TPM 11 is curved or bent. The degree of curving or bending increases the column stiffness of the TPM 11 which minimizes the formation of image and physical defects, such wrinkles.

The location of the curved first cooling section 46 is also important. The curved first cooling section 46 of the cooling article 44 located immediately at the oven exit 24 of the thermal processor 13 so as to receive the TPM 11 just after the TPM 11 is heated to the development processing temperature. With the correct location, curvature, and contact time with the TPM 11, the curved first cooling section 46 can cool a heated TPM 11 without the formation of image marring cooling induced wrinkles. Final cooling of the TPM 11 occurs as the heated TPM 11 passes over the straight second cooling section 48 of the cooling article 44. Because final cooling of the TPM 11 occurs while the TPM 11 is straight, curling of the TPM 11 can be minimized.

To control the cooling rate of the TPM 11, due to contact with the cooling article 44, the cooling article 44 is made of a combination of materials. Each of the materials has a different thermal conductivity. The first and second cooling sections 46 and 48 of the cooling article 44 are made of a relatively high thermal conductivity material (e.g., aluminum or stainless steel). This constitutes a first layer of the cooling article 44. This first high thermal conductivity layer is spaced from the imaging material to be cooled by a second layer of low thermal conductivity material (e.g., velvet or felt). This second layer is positioned on the first layer and directly contacts the imaging material to be cooled. This second low thermal conductivity layer takes the form of a single piece of material 50 that extends over both the first and second cooling sections 46 and 48 of the cooling article 44.

The single piece of material 50 is designed to be readily removed from the cooling article 44 so that it can be periodically replaced. As seen best in FIG. 6, to this end, a first end 62 of the material 50 is attached to a median wall 64 of the cooling article 44 via a hook and loop separable fastener 66. A second end 68 of the material 50 includes a loop 70 that receives a rod element 72. Free ends 74 (FIG. 3) of the rod element 72 hook over bracket members 76 of the cooling apparatus 10. As seen best in FIG. 6, to remove/replace the material 50, handles 75 of the hinged cover 42 are grasped and the hinged cover 42 is opened by overcoming the attractive force of magnetic elements 77. The free ends 74 of the rod element 72 are then lifted clear of the bracket members 76 (see dashed line representation) to detach the first end 62 of the material 50 from the cooling article 44. The second end 68 of the material 50 is detached from the cooling article 44 by separating the hook and loop fastener 66. The material 50 is then removed from the cooling chamber 36. To load a replacement material 50 onto the cooling article 44 the above procedure is simply reversed.

The cooling apparatus 10 also makes use of first and second streams S1 and S2, respectively, of cooling air that further help to cool the TPM 11. The first stream S1 of cooling air is directed at a rear cooling surface 80 of the cooling article 44. The first stream S1 of cooling air can be created by a first fan 82 which pulls air in from outside the cooling apparatus 10 and directs the air against the rear cooling surface 80. This first stream S1 can exit the cooling apparatus 10 through an outlet 84. Alternatively, the first fan 82 could simply be omitted from the cooling apparatus 10 and cooling of the cooling article 44 could occur through simple convective ambient air circulation. The second stream S2 of cooling air can flow adjacent to the TPM 11 to remove gaseous by-products of the thermal development process. The second stream S2 can flow through the thermal processor 13 beginning at the oven entrance 22 and terminating at a filter/fan mechanism 86.

As seen in FIGS. 1–6, the cooling apparatus 10 further includes an imaging material transport mechanism 90 located adjacent to the straight, second cooling section 48 of the cooling article 44. The transport mechanism 90 includes a pair of nip rollers 92A and 92B for engaging the TPM 11 to convey the TPM 11 over the first and second cooling sections 46 and 48 of the cooling article 44. The nip roller 92A is a drive roll while the nip roller 92B is a driven or idler roll. The driving nip roller 92A includes a pulley 94 that is operably connected to the drive motor 28 via a drive belt 26C coupled to the pulley 25 of the lower roller 17 that is nearest the oven exit 24. Alternatively, driving nip roller 92A could be driven from the lower roller 17 through a series of gears, or the driving nip roller 92A could be driven directly from the drive motor 28. The imaging material transport mechanism 90 of the cooling apparatus 10 operates at an operational rate of speed that is greater than the operational and conveying rates of speed of the of the imaging material conveyance device 15 of the thermal processor 13.

As seen best in FIG. 1, for the majority of its transportation time through the cooling apparatus 10, both the conveyance device 15 and the transport mechanism 90 act on the TPM 11. Because of this, and since the imaging material transport mechanism 90 of the cooling apparatus 10 has a higher operational rate of speed than the imaging material conveyance device 15 of the thermal processor 13, the transport mechanism 90 applies tension to the TPM 11 as the TPM 11 passes over the cooling article 44. To permit this overspeeding of the operational rate of speed of the transport mechanism 90 relative to the operational and conveying rates of speed of the conveyance device 15, the transport mechanism includes a slip mechanism 96. This slip mechanism 96 allows the operational rate of speed of the transport mechanism 90 to be greater than an imaging material conveying rate of speed at which the transport mechanism 90 conveys the TPM 11 over the cooling article 44.

In practice, the conveying rate of speed of the transport mechanism 90 and the operational and conveying rates of speed of the conveyance device 15 are all substantially equal. However, the operational rate of speed of the transport mechanism 90 is approximately between 3.0% and 9.0% (preferably 6.7%) greater than the conveying rate of speed of the transport mechanism 90 and the operational and conveying rates of speed of the conveyance device 15. To achieve this speed differential, the pulley 94 of the driving nip roller 92A has fifteen teeth and the pulleys 25 have sixteen teeth.

Figure 4:
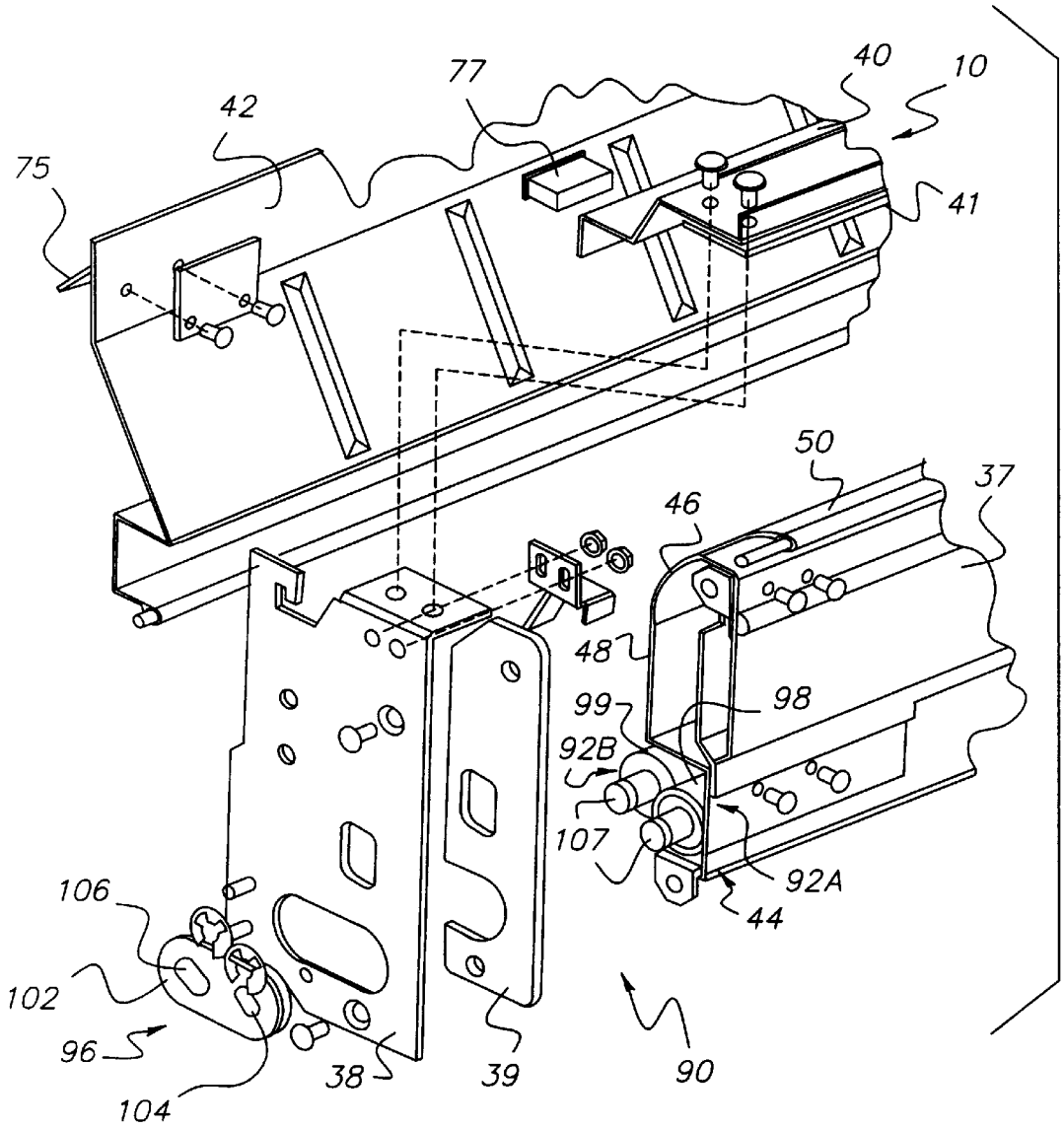
FIG. 4 is an enlarged, exploded perspective view illustrating details of one end of a nip roller mechanism of the cooling apparatus.
Figure 5:
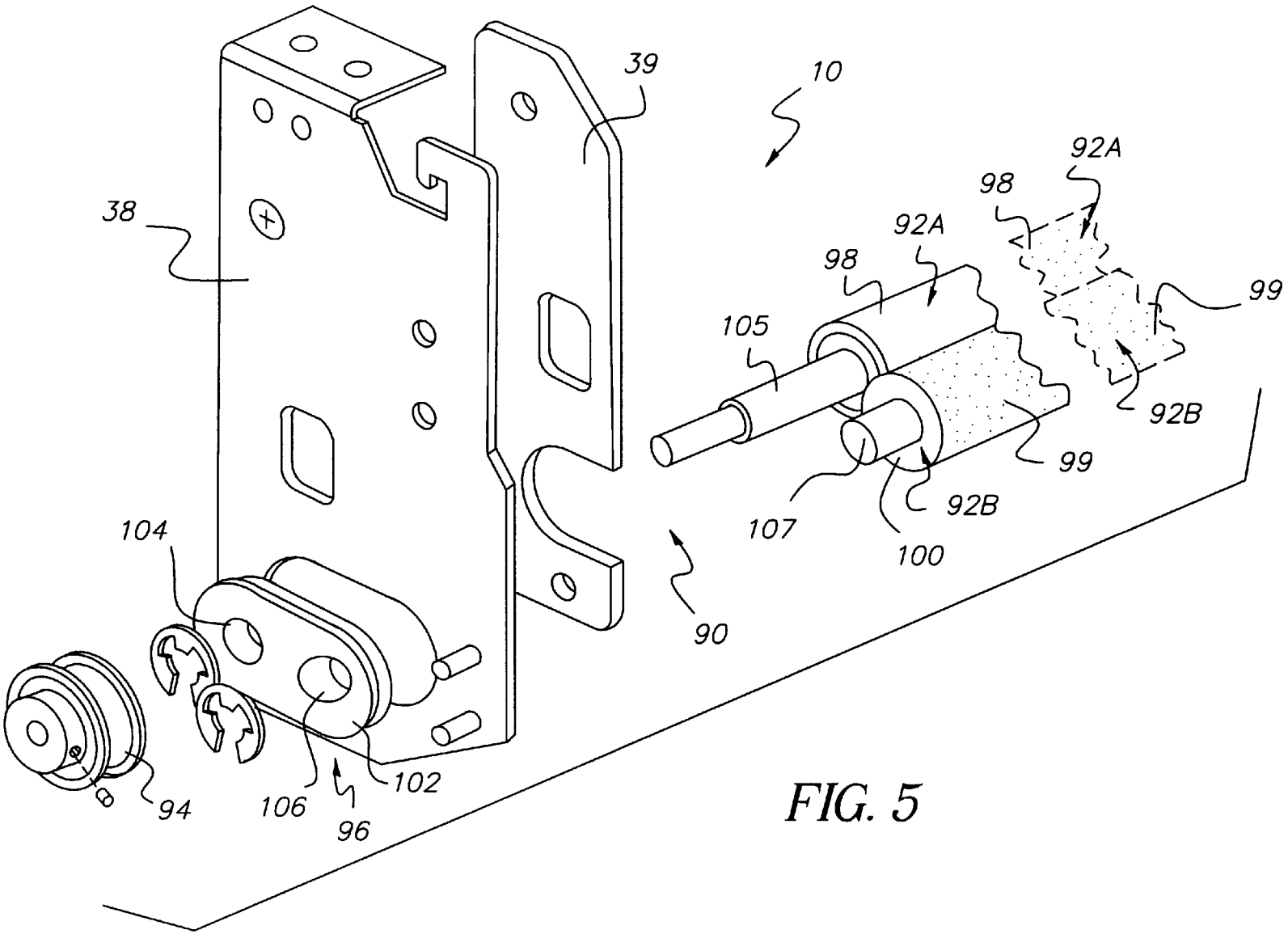
FIG. 5 is an enlarged, exploded perspective view illustrating details of an opposite end of the nip roller mechanism of the cooling apparatus.

As seen best in FIGS. 1 and 3–6, the driving nip roller 92A includes a smooth, low friction outer surface 98, while the driven nip roller 92B has a textured outer surface 99 that exhibits higher friction than the smooth outer surface 98 of the driving nip roller 92A. In one preferred embodiment the smooth outer surface 98 of the driving nip roller 92A is a result of manufacturing the nip roller 92A out of polished aluminum. The textured outer surface 99 of the driven nip roller 92B is a silicon foam sleeve 100 (FIG. 5). The smooth outer surface 98 defines a portion of the slip mechanism 96 since the smooth outer surface 98 of the driving nip roller 92A allows the nip rollers 92A and 92B to have a limited amount of slip relative to the TPM 11 being conveyed thereby. Alternatively, as seen by the dashed line representation in FIG. 5, the outer surfaces 98 and 99 of the driving and driven nip rollers 92A and 92B could both be textured and provide a desired limited amount of slip relative to certain types of TPM 11.

As seen best in FIGS. 3–5, the slip mechanism 96 further includes bearing block mechanisms 102 for mounting the nip rollers 92A and 92B within the cooling apparatus 10. Each bearing block mechanism 102 includes a round aperture 104 for receiving opposite ends 105 of the driving nip roller 92A. The round apertures 104 limit the driving nip roller 92A to rotational movement. Each bearing block mechanism 102 further includes a longitudinally extending slot 106 for receiving opposite ends 107 of the driven nip roller 92B. The slots 106 not only permit rotational movement of the driven nip roller 92B but allow the driven nip roller 92B to freely slidably move towards and away from the driving nip roller 92A along longitudinal axes 108 of the slots 106 (see the solid line and dashed line representations of the driven nip roller 92B in FIG. 6). This movement of the driven nip roller 92B relative to the driving nip roller 92A allows the nip rollers 92A and 92B to have a limited amount of slip relative to the TPM 11 being conveyed thereby. As seen in FIG. 6, each of the longitudinal axes 108 of the slots 106 forms an angle $\Phi$ approximately between a 30° and a 90° angle (preferably a 45° angle) with respect to a single line 110 that is tangent to both the nip rollers 92A and 92B and is parallel to the straight second cooling section 48 of the cooling article 44. Gravity and the weight of the driven nip roller 92B biases the driven nip roller 92B towards to driving nip roller 92A so as to provide enough force to allow the transport mechanism to impart tension to the TPM 11 and convey the TPM 11 over the cooling article 44.

The cooling apparatus 10 minimizes physical and image defects during cooling. Since the imaging material transport mechanism 90 of the cooling apparatus 10 has a higher operational rate of speed than the imaging material conveyance device 15 of the thermal processor 13, the transport mechanism 90 applies tension to the imaging material 11 as the imaging material 11 passes over the cooling article 44. This tension insures that the imaging material 11 evenly contacts the cooling article 44 and thereby insures even cooling of the developed imaging material. In addition, the tension also helps to control the dimensional changes that occur in the developed imaging material during cooling. Even cooling of the imaging material 11, and control of imaging material dimensional changes reduces thermal stresses and contraction within the imaging material 11. By reducing imaging material thermal stresses and contraction, physical and image wrinkles, streaks, and/or spots in the developed imaging material are minimized, which significantly improves the quality of the developed image.

By operating at a higher rate of speed than the conveyance device 15 of the thermal processor 13, the transport mechanism of the cooling apparatus also prevents buckling of the imaging material 11 caused by a speed mismatch where the transport mechanism 90 of the cooling apparatus 10 is operating at a speed slower than the speed of the conveyance device 15 of the thermal processor 13. By preventing buckling of the developed imaging material, uneven contact between heated development rollers 16 and 17 of the thermal processor 13 and the imaging material 11, during the development process, is minimized. Hence, there is a corresponding reduction in under-developed portions of the imaging material 11 which translates into fewer image and physical artifacts that would adversely affect the quality of the developed image. The cooling apparatus 10 of the present invention minimizes these physical and image artifacts while offering acceptable cooling productivity, cost effectiveness and ease of assembly and repair.

Although the present invention has been described with reference to preferred embodiments, workers skilled in the art will recognize that changes may be made in form and detail without departing from the spirit and scope of the invention.

What is claimed is:

1. An apparatus for cooling a thermally processed, imaging material which has been heated to a first temperature by a thermal processor of the type having an imaging material conveyance device operating at an operational rate of speed, the cooling apparatus comprising:

a cooling article on which imaging material rides after the imaging material exits a thermal processor at a first temperature, the cooling article having a second temperature that is lower than the first temperature so as to cool the imaging material; and imaging material transport means adjacent the cooling article for engaging the imaging material to convey the imaging material over the cooling article, the transport means operating at an operational rate of speed that is greater than an operational rate of speed of an imaging material conveyance device of the thermal processor so that said imaging material evenly contacts said cooling article to insure even cooling of said imaging material and to control the dimensional changes in said imaging material during cooling.

2. The cooling apparatus of claim 1 wherein the operational rate of speed of the imaging material transport means is greater than the operational rate of speed of the imaging material conveyance device of the thermal processor.

3. The cooling apparatus of claim 2 wherein the transport means conveys the imaging material at an imaging material conveying rate of speed that is different than the operational rate of speed of the transport means.

4. The cooling apparatus of claim 3 wherein the operational rate of speed of the imaging material transport means is greater than the conveying rate of speed of the transport means.

5. The cooling apparatus of claim 4 wherein the operational rate of speed of the imaging material transport means is approximately between 3.0% and 9.0% greater than the conveying rate of speed of the transport means.

6. The cooling apparatus of claim 5 wherein the operational rate of speed of the imaging material transport means is approximately 6.7% greater than the conveying rate of speed of the transport means.

7. The cooling apparatus of claim 3 wherein the operational rate of speed of the imaging material transport means is greater than the conveying rate of speed of the transport means, and wherein the conveying rate of speed of the transport means is substantially equal to the operational rate of speed of the imaging material conveyance device and an imaging material conveying rate of speed of the conveyance device of the thermal processor.

8. The cooling apparatus of claim 3, and further including:

means for allowing the imaging material transport means to slip relative to the imaging material being conveyed thereby, to permit the operational rate of speed of the transport means to be greater than the conveying rate of speed of the transport means, so that the transport means applies tension to the imaging material to minimize defects in the imaging material that has been cooled by the cooling article.

9. The cooling apparatus of claim 8 wherein the transport means includes:

a pair of nip rollers for conveying the imaging material over the cooling article, the nip rollers including:

a driving roll operably connected to a drive means, the driving roll operating at the operational rate of the speed of the transport means to convey the imaging material at the conveyance rate of speed of the transport means; and a driven roll.

10. The cooling apparatus of claim 9 wherein the slip means includes a smooth, low friction outer surface on one of the driving roll and the driven roll that allows the pair of nip rollers to slip relative to the imaging material being conveyed thereby.

11. The cooling apparatus of claim 10 wherein the driving roll has the smooth, low friction outer surface.

12. The cooling apparatus of claim 11 wherein the driven roll has a textured outer surface exhibiting higher friction than the smooth, low friction outer surface of the driving roll.

13. The cooling apparatus of claim 9 wherein the slip means includes textured outer surfaces on the driving and driven rolls that allows the pair of nip rollers to slip relative to the imaging material being conveyed thereby.

14. The cooling apparatus of claim 9 wherein the slip means includes means for mounting one of the driving roll and the driven roll so as to allow that roll to freely move towards and away from the other one of the driving roll and the driven roll, thereby allowing the pair of nip rollers to slip relative to the imaging material being conveyed thereby.

15. The cooling apparatus of claim 14 wherein the mounting means allows the driven roll to move relative to the driving roll.

16. The cooling apparatus of claim 15 the driven roll has first and second opposite ends, and wherein the mounting means includes a pair of longitudinally extending slots for slidably receiving the first and second ends of the driven roll.

17. The cooling apparatus of claim 16 wherein each of the longitudinally extending slots has a longitudinal axis, and wherein each longitudinal axis forms approximately between a 30° and a 60° angle with respect to a single line tangent to both the driving and driven rolls.

18. The cooling apparatus of claim 17 wherein each longitudinal axis of the longitudinally extending slots forms approximately a 45° angle with respect to the single line tangent to both the driving and driven rolls.

19. The cooling apparatus of claim 1 wherein the cooling article includes a first, generally curved cooling section and a second generally straight cooling section, and wherein each of the first and second cooling sections includes a first layer of a relatively high thermal conductivity material spaced from the imaging material by a second layer of a relatively low thermal conductivity material that is positioned on the first layer to contact the imaging material.

20. The cooling apparatus of claim 19 wherein the second layer of relatively low thermal conductivity material is a single piece of material that extends over both the first and second cooling sections and wherein the single piece of material includes means to allow the single piece of material to be readily removed from the cooling article to be replaced.

21. An apparatus for cooling a thermally processed, imaging material which has been heated to a first temperature by a thermal processor, the cooling apparatus comprising:

a cooling article on which imaging material rides after the imaging material exits a thermal processor at a first temperature, the cooling article having a second temperature that is lower than the first temperature so as to cool the imaging material;

imaging material transport means adjacent the cooling article for engaging the imaging material to convey the imaging material over the cooling article at an imaging material conveying rate of speed, the transport means operating at an operational rate of speed that is different than the conveying rate of speed of the transport means; and means for allowing the imaging material transport means to slip relative to the imaging material being conveyed thereby, to permit the operational rate of speed of the transport means to be greater than the conveying rate of speed of the transport means, so that the transport means applies tension to the imaging material to minimize defects in the imaging material that has been cooled by the cooling article.

22. The cooling apparatus of claim 21 wherein the transport means includes:

a pair of nip rollers for conveying the imaging material over the cooling article, the nip rollers including:

a driving roll operably connected to a drive means, the driving roll operating at the operational rate of the speed of the transport means to convey the imaging material at the conveyance rate of speed of the transport means; and a driven roll.

23. The cooling apparatus of claim 22 wherein the slip means includes a smooth, low friction outer surface on one of the driving roll and the driven roll that allows the pair of nip rollers to slip relative to the imaging material being conveyed thereby.

24. The cooling apparatus of claim 22 wherein the slip means includes means for mounting one of the driving roll and the driven roll so as to allow that roll to freely move towards and away from the other one of the driving roll and the driven roll, thereby allowing the pair of nip rollers to slip relative to the imaging material being conveyed thereby.

* * * * *